United States Patent [19]

Frawley

[11] Patent Number: 4,710,140

[45] Date of Patent: Dec. 1, 1987

[54] PLIERS CRIMPABLE TERMINAL

[75] Inventor: Lanny J. Frawley, St. Charles, Ill.

[73] Assignee: Cooper Industries, Inc., Houston, Tex.

[21] Appl. No.: 21,165

[22] Filed: Mar. 3, 1987

[51] Int. Cl.[4] ..... H01R 13/415

[52] U.S. Cl. ..... 439/733; 29/866; 439/741

[58] Field of Search ..... 339/223 R, 223 S, 97 S, 339/276 R, 276 SF, 276 T; 29/866

[56] References Cited

U.S. PATENT DOCUMENTS

| | | | |
|---|---|---|---|
| 1,672,201 | 6/1928 | Champion | 339/223 S X |
| 3,184,704 | 5/1965 | Raymond et al. | 339/223 R X |
| 3,404,368 | 10/1968 | Roberts | 339/223 S |

*Primary Examiner*—Eugene F. Desmond
*Attorney, Agent, or Firm*—Fitch, Even, Tabin & Flannery

[57] ABSTRACT

A metallic terminal for use with a conductor having a conductive core and a jacket of insulation about the core. The terminal includes a deformable barrel for receiving the conductor, and a portion for contacting another electrical component. The barrel has an axis and includes a channel with a first end and a second end extending generally parallel to the axis. The barrel further includes a finger extending from the first channel end at least substantially across the opening of the channel and having a pointed distal end directed inside the channel. The barrel further includes a first abutment associated with the first channel end for engagement by one of the jaws of a pliers, and a second abutment associated with the second end of the channel for engagement by the other of the jaws of the pliers. Thus, after insertion of the conductor into the barrel with the core, from which a jacket portion is stripped, folded back over the jacket, closing of the jaws of the pliers results in the channel being deformed to compressively hold the conductor and the finger distal end piercing the jacket but not the core. A method of using the terminal is also disclosed.

12 Claims, 7 Drawing Figures

PLIERS CRIMPABLE TERMINAL

The present invention relates generally to terminals for electrical conductors and, more particularly, to a terminal for an ignition cable which can be applied using a pair of pliers.

BACKGROUND OF THE INVENTION

In the ignition system of an internal combustion engine, high voltage for causing sparking is supplied from the distributor to the spark plugs by ignition cables. There are several types of ignition cables but they typically have a conductive core encompassed by a jacket of insulation, such as rubber. Older designs of ignition cables included a metallic core. More recent designs are of the resistive type for suppressing radio frequency interference. Such designs may have a conductive core formed of fiberglass strands bonded together with a bonding material impregnated with carbon, or a very fine resistance wire might be wound around a bundle of fiberglass strands.

These ignition cables are customarily terminated for connection to the spark plug terminal after a portion of the jacket is removed and the core is folded back over the remaining jacket at the end of the cable. The electrical terminal for the ignition cable has a barrel for receiving the dressed cable end. Special tooling may be required to radially indent the barrel to compressively hold the cable and to establish good contact with the exposed core. For a more detailed explanation of the structure and operation of such prior art terminals, reference may be made to U.S. Pat. Nos. 2,816,276 and 3,518,606.

Another prior art design is for application in the field using only a pair of pliers. This terminal has a channel-shaped barrel having a pair of arms which are individually bent over the cable end to compressively hold the cable. Operator judgment is required in determining how forcefully to deform the arms.

SUMMARY OF THE INVENTION

Among the several aspects and features of the present invention may be noted the provision of an improved terminal for an ignition cable. The terminal, which can be applied in the field using only a pair of pliers, functions to not only hold the cable by compression, but also by piercing the insulative jacket of the cable. The terminal of the present invention limits the extent the barrel can be deformed to reduce the need for user judgment. The terminal is reliable in use, has long service life, and is simple and economical to manufacture. Other aspects and features of the subject invention will be in part apparent and in part particularly pointed out in the following specification and accompanying drawings.

Briefly, the metallic terminal of the present invention includes a deformable barrel for receiving the conductor and a portion for contacting another electrical component. The barrel has an axis and includes a channel having first and second ends extending generally parallel to the axis. A first finger extends from the first channel end at least substantially across the opening of the channel and has a pointed free end directed inside the channel. The barrel also has first abutment associated with the first end for engagement by one of the jaws of a pliers, and a second abutment associated with the second channel end for engagement by the other of the jaws of the pliers.

As a method, the present invention includes the following steps:

(a) preparing the cable by stripping away part of the jacket and folding the exposed core back over the remaining jacket at one end of the cable;

(b) inserting the prepared cable into the barrel of the terminal;

(c) engaging the respective abutments with the corresponding jaws of the pliers; and (d) using the pliers to deform the barrel to compressively hold the cable with the finger piercing the jacket.

BRIEF DESCRIPTION OF THE DRAWINGS

Corresponding reference characters indicate corresponding components throughout the several views of the drawings.

DESCRIPTION OF THE PREFERRED EMBODIMENTS

Figure 1:
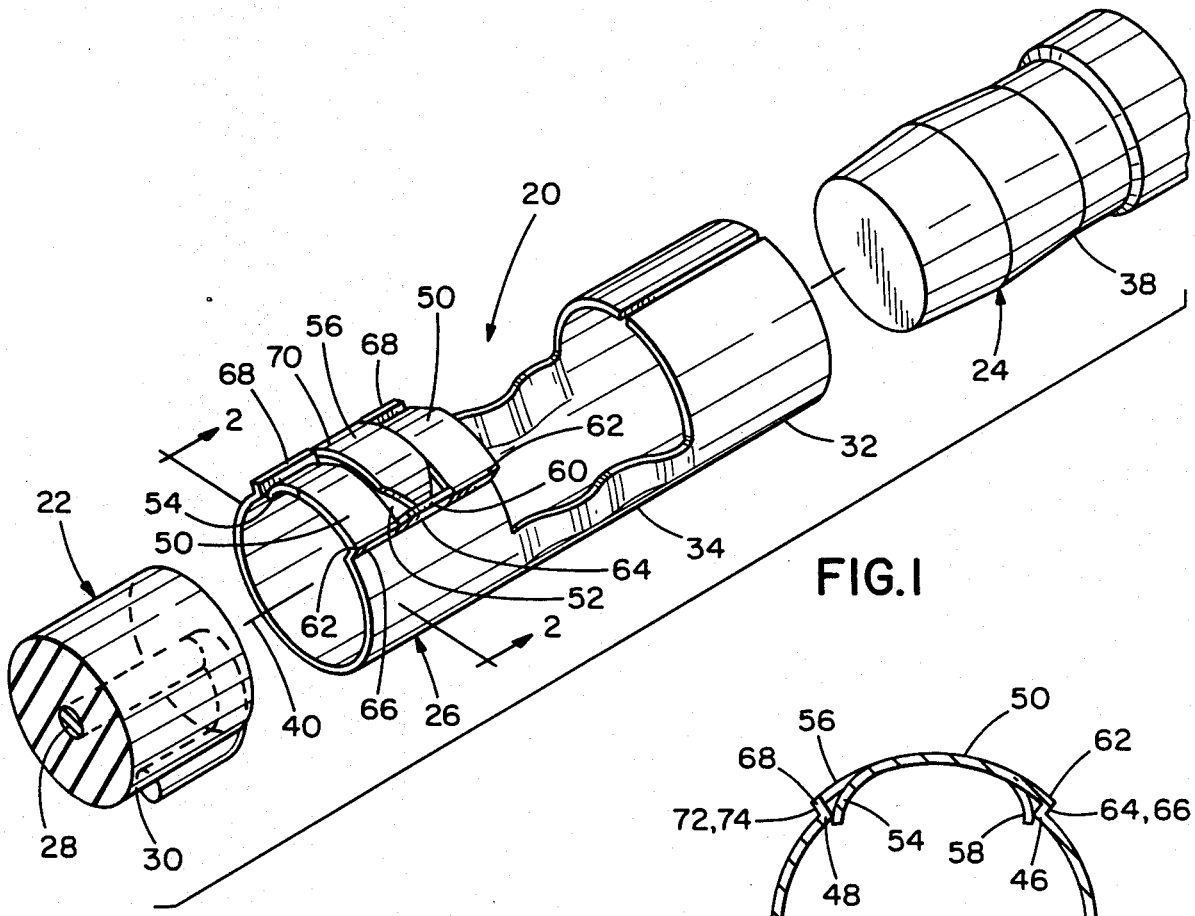
FIG. 1 is a perspective view of an ignition cable terminal embodying various features of the present invention.

Referring now to the drawings, an elongate terminal of the present invention for crimping onto the end of an ignition cable 22 and mechanically and electrically connecting it to another electrical component such as the terminal 24 of a spark plug, is generally indicated by reference numeral 20 in FIGS. 1–4. The terminal 20 includes a barrel 26 for crimping, by using a simple hand pliers, about the end of the cable, which includes a conductive or semiconductive core 28 and a jacket 30 of electrical insulation such as rubber, after the cable has been prepared or dressed by removing a part of the jacket and folding the exposed core back over tne remaining jacket as shown in FIG. 1. Terminal 20, which is preferably formed by stamping and folding of a blank of a metal such as cold rolled steel plated with zinc for corrosion protection, further includes a guide collar 32 for receiving the spark plug terminal 24. Interconnecting the barrel 26 and the collar 32 is an intermediate portion 34 for receiving the spark plug terminal. Collar 32 includes means, not shown, for holding the spark plug terminal 24, such means being well known to those of skill in the art.

More specifically, the deformable barrel 26 has an axis 40 and includes a semi-cylindrical channel 42 having a wall 44 extending through an angle about the axis 40 of between about 220 degrees and 300 degrees, with about 260 degrees being preferable. The channel 42 has a first end 46 and a second end 48 which extend generally parallel to axis 40. The barrel further includes an arcuate first finger 50 extending from the first channel end 46 at least substantially across the opening 52 of the channel and having a generally pointed distal end 54 directed inside the channel. A second finger 56, also part of the barrel, extends adjacent the first finger 50 from the second channel end 48 and terminates in a pointed free end 58 directed inside the channel. The barrel preferably has at least three fingers, a pair of first fingers 50 flanking a second finger 56. An advantage of three or more fingers is that portions of the flanking fingers guide the interior finger to prevent substantially axial movement of the interior finger as the barrel is crimped.

The barrel 26 further includes first abutment means associated with the first channel end for engagement by one of the jaws of the pliers, and second abutment means associated with the second channel end for engagement by the other of the jaws of the pliers. The first abutment means is constituted by a lip 60 extending from the first channel end 46 away from the axis and aligned with the second finger 56. The first abutment means is further made up by step portions 62 of the first fingers 50 extending away from the axis 40. The lip 60 and the step portions 62 have jaw engagement surfaces 64 and 66, respectively, which are substantially coplanar and extend generally radially of the axis 40. Similarly, the second abutment means is constituted by lips 68 extending from the second channel end 48 away from the axis end in alignment with the respective first fingers 50, and further by a step portion 70 of the second finger 56 extending away from the axis 40. The lips 68 and the step portion 70 have respective engagement surfaces 72 and 74 which are substantially coplanar and extend generally radially of the axis 40.

Figure 2:
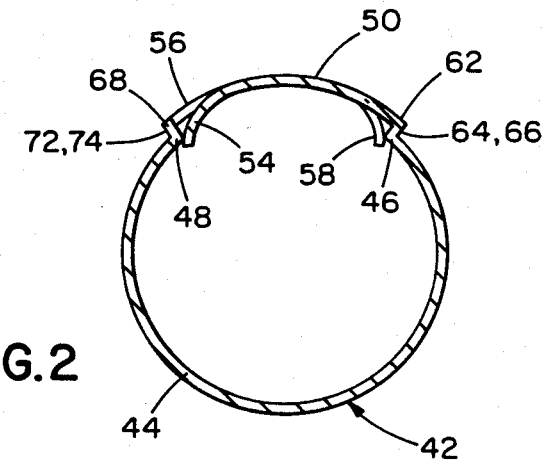
FIG. 2 is a sectional view taken generally along line 2—2 of FIG. 1.
Figure 3:
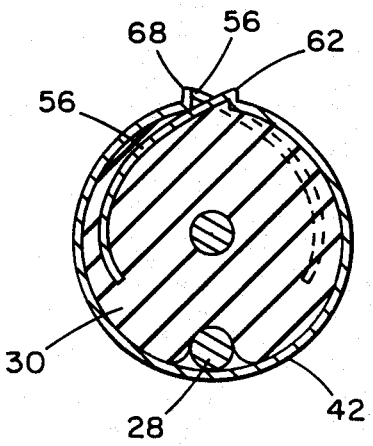
FIG. 3, similar to FIG. 2, shows the terminal barrel crimped about the ignition cable.
Figure 4:
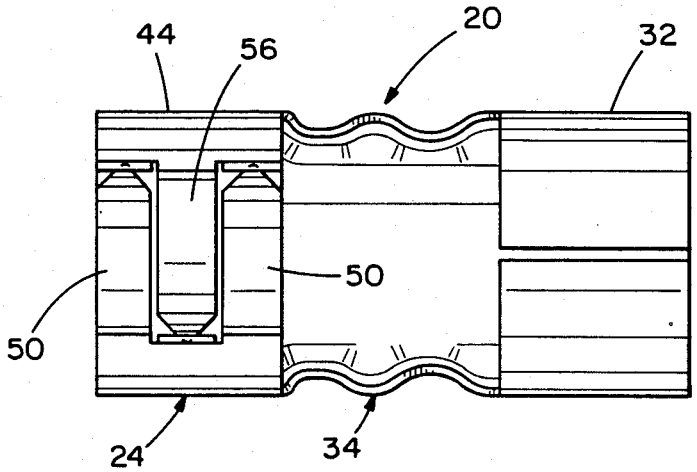
FIG. 4 is a plan view of the terminal of FIG. 1.

Referring to FIGS. 2 and 3, which show the barrel before and after crimping, respectively, it will be appreciated that the composite engagement surface 64, 66 of the first abutment means and the composite engagement surface 72, 74 of the second abutment means diverge outwardly. This is true in the as-formed condition of the barrel and in the deformed or crimped condition of the barrel. This divergent surface configuration assures that the pliers jaws have a good grip or "bite" on the barrel components as the barrel is moved towards its crimped condition. It will also be appreciated that the provision of the jaw abutment means reduces operator judgment because the movement of the two abutment means toward each other is limited to prevent overly deforming the barrel which could damage the terminal 20 or the ignition cable 22.

Referring particularly to FIG. 2, the major portions of the fingers 50, 56 define parts of circles wnich are generally concentric with the circle partially defined by the wall 44 of the channel 42. However, the distal ends of the fingers are curled inwardly and disposed beneath and in contact with corresponding cnannel ends. As the finger distal ends are closer to axis 40 than are the channel ends, because the barrel is deformed, the distal ends can move to pierce the jacket of the ignition cable without interference from the channel ends.

Operation of the terminal 20 of the present invention is as follows: After the prepared ignition cable 22 is inserted into the barrel 26 with the exposed core 28 bent back over the jacket 30, the pliers jaws are positioned on their respective abutments. The operator then closes the jaws of the pliers causing the barrel 26 to deform thereby compressively holding the ignition cable. As the jaws are closed, the finger distal ends 52, 54 pierce the jacket 30 to further aid in the retention of the ignition cable 22 in the terminal. It will be appreciated that the fingers pierce the jacket but do not contact the core 28 of the ignition cable which has not been folded back. Thus, there is no chance that the fingers would damage the core to impair the electrical characteristics of the ignition cable-terminal combination.

Figure 5:
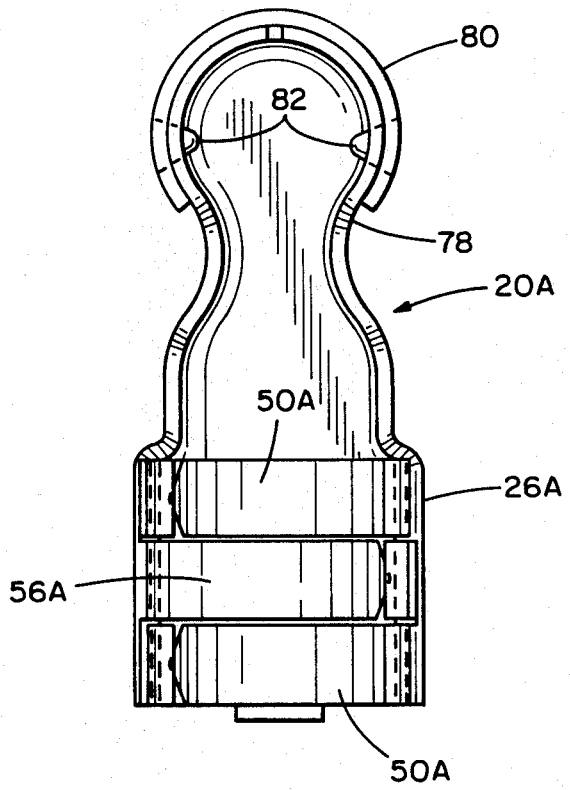
FIG. 5 is a bottom view of an alternative embodiment of a terminal embodying various features of the present invention.
Figure 6:
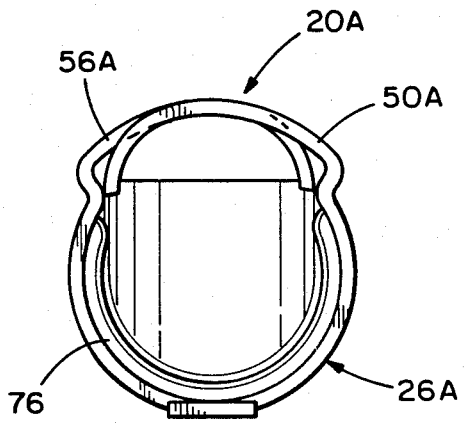
FIG. 6 is an end view of the terminal of FIG. 5.
Figure 7:
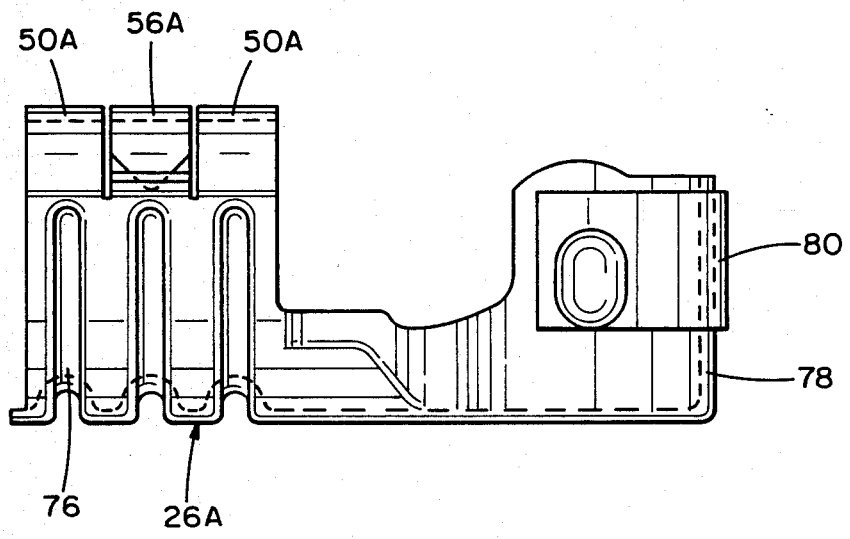
FIG. 7 is a side elevational view of the terminal of FIG. 5.

An alternative embodiment of a terminal embodying various features of the present invention is indicated in FIGS. 5–7 by reference character 20A. Components of terminal 20A corresponding to components of terminal 20 are indicated by the reference numeral assigned to the component of terminal 20 with the addition of the suffix "A". The terminal 20 is an in-line configuration while terminal 20A is a right angle configuration. The respective barrels of the terminals are substantially identical except barrel 26A has inner ribs 76 to indent the cable jacket. While terminal 20 is integral in the sense that it is formed from a single blank, terminal 20A has a cap 78 carrying a split ring 80 formed of spring steel having a pair of inwardly directed noses 82, formed by dimpling the outer surface of the ring. The noses 82 extend through windows in the cap to hold the components assembled and the noses 82 are received in the annular groove 38 of the spark plug terminal to releasably mount the terminal 20A on the spark plug. The terminal 20A is still a one-piece design in that there are no loose pieces for the user to assemble in the field.

As a method, the present invention includes the following steps:

(a) the ignition cable is prepared by stripping away part of the jacket 30 and folding the exposed core 28 back over the remaining jacket at one end of the cable;

(b) the prepared cable is inserted into the barrel 26;

(c) the respective abutments of the barrel are engaged by the jaws of the pliers; and (d) the pliers are closed to deform the barrel to compressively hold the cable with the finger piercing the jacket.

In view of the above, it will be seen that the several objects of the invention are achieved and other advantageous results attained.

As various changes could be made without departing from the scope of the invention, it is intended that all matter contained in the above description shall be interpreted as illustrative and not in a limiting sense.

What is claimed is:

1. A metallic terminal for use with a conductor having a conductive-core and a jacket of electrical insulation disposed about the core, said terminal comprising a deformable barrel for receiving said conductor, and a portion for contacting another electrical component, said barrel having an axis and comprising:

a channel having a first end and a second end with said ends extending generally parallel to said axis;

a first finger extending from said first end at least substantially across the opening of said channel and having a pointed distal end directed inside said channel;

first abutment means associated with said first end for engagement by one of the jaws of a pliers; and second abutment means associated with said second end for engagement by the other of the jaws of said pliers whereby after insertion of said conductor into said barrel with the core, from which a jacket portion was stripped, folded back over the jacket, closing tne jaws of the pliers results in the channel being deformed to compressively hold said conductor and said finger distal end piercing said jacket.

2. A terminal as set forth in claim 1 further comprising a second finger extending adjacent said first finger from said second end at least substantially across the opening of said channel and having a pointed distal end directed inside said channel.

3. A terminal as set forth in claim 2 wherein said finger distal ends are disposed closer said axis than said channel ends.

4. A terminal as set forth in claim 3 wherein the distal end of said first finger distal end engages said second channel end and said second finger distal end engages said first channel end.

5. A terminal as set forth in claim 2 wherein said barrel includes a pair of said first fingers flanking said second finger.

6. A terminal as set forth in claim 2 wherein said first abutment means comprises a lip extending from said first channel end away from said axis and aligned with said second finger.

7. A terminal as set forth in claim 2 wherein said first abutment means comprises a step portion of said first finger extending away from said axis.

8. A terminal as set forth in claim 6 wherein said first abutment means further comprises a step portion of said first finger extending away from said axis, said lip and said step portion having respective engagement surfaces which are substantially coplanar and extend generally radially of said axis.

9. A terminal as set forth in claim 1 wherein said channel is arcuate and extends through an angle of between 220 degrees and 300 degrees.

10. In combination, an ignition cable including a conductive core surrounded by a jacket of insulation and a metallic terminal comprising:

a crimped barrel holding an end portion of said cable after said cable is dressed by stripping away insulation and folding the exposed core back over remaining insulation at said cable end portion; and a portion for contacting another electrical component, said barrel having an axis and comprising:

a channel compressively holding said cable end portion and having a first end and a second end with said ends extending generally parallel to said axis;

a first finger extending from said first end across the opening of said channel and having a pointed distal end directed inside said channel and piercing the jacket but not contacting the part of the core not folded back over the jacket;

first abutment means associated with said first end for engagement by one of the jaws of a pliers; and second abutment means associated with said second end for engagement by the other of the jaws of said pliers to permit use of said pliers for deformation of said barrel from an as-manufactured condition to a crimped condition holding said cable both by compression and by said finger piercing said jacket.

11. A combination as set forth in claim 10 wherein said barrel further includes a second finger extending adjacent said first finger from said second end across the channel opening and having a pointed distal end directed inside said channel and piercing said jacket but not contacting the part of the core not folded back over the jacket, said barrel having a pair of said first fingers flanking said second finger.

12. A method for applying a metallic terminal to an ignition cable having a conductive core and a jacket of electrical insulation disposed about the core, said terminal comprising a deformable barrel for receiving said conductor, and a portion for contacting another electrical component, said barrel having an axis and comprising:

a channel having a first end and a second end with said ends extending generally parallel to said axis;

a first finger extending from said first end at least substantially across the opening of said channel and having a pointed distal end directed inside said channel;

first abutment means associated with said first end for engagement by one of the jaws of a pliers; and second abutment means associated with said second end for engagement by the other of the jaws of said pliers, said method comprising the following steps:

(a) preparing the cable by stripping away part of said jacket and folding the exposed core back over the remaining jacket at one end of the cable;

(b) inserting the prepared cable into said barrel;

(c) engaging the respective abutment means with jaws of the pliers; and (d) using the pliers to deform the barrel to compressively hold said cable with said finger piercing said jacket.

* * * * *

UNITED STATES PATENT AND TRADEMARK OFFICE

CERTIFICATE OF CORRECTION

PATENT NO. : 4,710,140

DATED : December 1, 1987

INVENTOR(S) : Lanny J. Frawley

It is certified that error appears in the above-identified patent and that said Letters Patent is hereby corrected as shown below:

Column 3, line 47, change "wnich" to --which--.

Column 3, line 51, change "cnannel" to --channel--.

Column 4, line 44, change "conductive-core" to --conductive core--.

Column 4, line 62, change "tne" to --the--.

Signed and Sealed this

Third Day of May, 1988

*Attest:*

*Attesting Officer*

DONALD J. QUIGG

*Commissioner of Patents and Trademarks*